US007472014B1

(12) United States Patent
Albertson et al.

(10) Patent No.: US 7,472,014 B1
(45) Date of Patent: Dec. 30, 2008

(54) FAST ACTIVE FUEL MANAGEMENT REACTIVATION

(75) Inventors: William C. Albertson, Clinton Township, MI (US); Frederick J. Rozario, Fenton, MI (US); Mike M. Mc Donald, Macomb, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/872,410

(22) Filed: Oct. 15, 2007

Related U.S. Application Data

(60) Provisional application No. 60/956,449, filed on Aug. 17, 2007.

(51) Int. Cl.
*F02D 41/00* (2006.01)

(52) U.S. Cl. ..... 701/103; 123/198 F

(58) Field of Classification Search ..... 701/103–105, 701/115; 123/198 F, 480
See application file for complete search history.

(56) References Cited

U.S. PATENT DOCUMENTS 4,111,010 A * 9/1978 Minami ..... 60/276
6,964,157 B2 * 11/2005 Adelman et al. ..... 60/278

* cited by examiner

*Primary Examiner*—Hieu T Vo

(57) ABSTRACT

An engine control module includes a valve control module that disables intake and exhaust valves corresponding to a cylinder that includes a mass of intake air. An engine cycle module determines a number of engine cycles that occurred while the cylinder is disabled. An air estimation module determines a remaining mass of air in the cylinder based on the number of engine cycles.

14 Claims, 5 Drawing Sheets

FAST ACTIVE FUEL MANAGEMENT REACTIVATION

CROSS-REFERENCE TO RELATED APPLICATIONS

This application claims the benefit of U.S. Provisional Application No. 60/956,449, filed on Aug. 17, 2007. The disclosure of the above application is incorporated herein by reference in its entirety.

FIELD

The present invention relates to internal combustion engines and more particularly to methods and systems for operating an active fuel management engine system.

BACKGROUND

The statements in this section merely provide background information related to the present disclosure and may not constitute prior art.

Internal combustion engines may include engine control systems that deactivate cylinders under specific low load operating conditions. For example, an eight cylinder engine may be operated using four cylinders to improve fuel economy by reducing pumping losses. This process is generally referred to as active fuel management (AFM). Operation using all of the engine cylinders is referred to as an "activated" mode. Conversely, operation using less than all of the cylinders of the engine (i.e. one or more cylinders are not active) is referred to as a "deactivated" mode.

In the deactivated mode, there are fewer firing cylinders. As a result, there is less drive torque available to drive the vehicle driveline and accessories (e.g., an alternator, coolant pump, and A/C compressor). However, the active cylinders operate at a higher efficiency due to reduced pumping losses and achieve better thermal and mechanical efficiency.

A lifter oil manifold assembly (LOMA) is implemented to activate and deactivate selected cylinders of the engine. The LOMA includes electrically operated solenoid valves associated with respective cylinders. The solenoids are selectively energized to enable hydraulic fluid flow to the lifters to inhibit valve lifter operation, thereby deactivating the corresponding cylinders.

SUMMARY

An engine control module includes a valve control module that disables intake and exhaust valves corresponding to a cylinder that includes a mass of intake air. An engine cycle module determines a number of engine cycles that occurred while the cylinder is disabled. An air estimation module determines a remaining mass of air in the cylinder based on the number of engine cycles.

BRIEF DESCRIPTION OF THE DRAWINGS

The drawings described herein are for illustration purposes only and are not intended to limit the scope of the present disclosure in any way.

DETAILED DESCRIPTION

Figure 1:
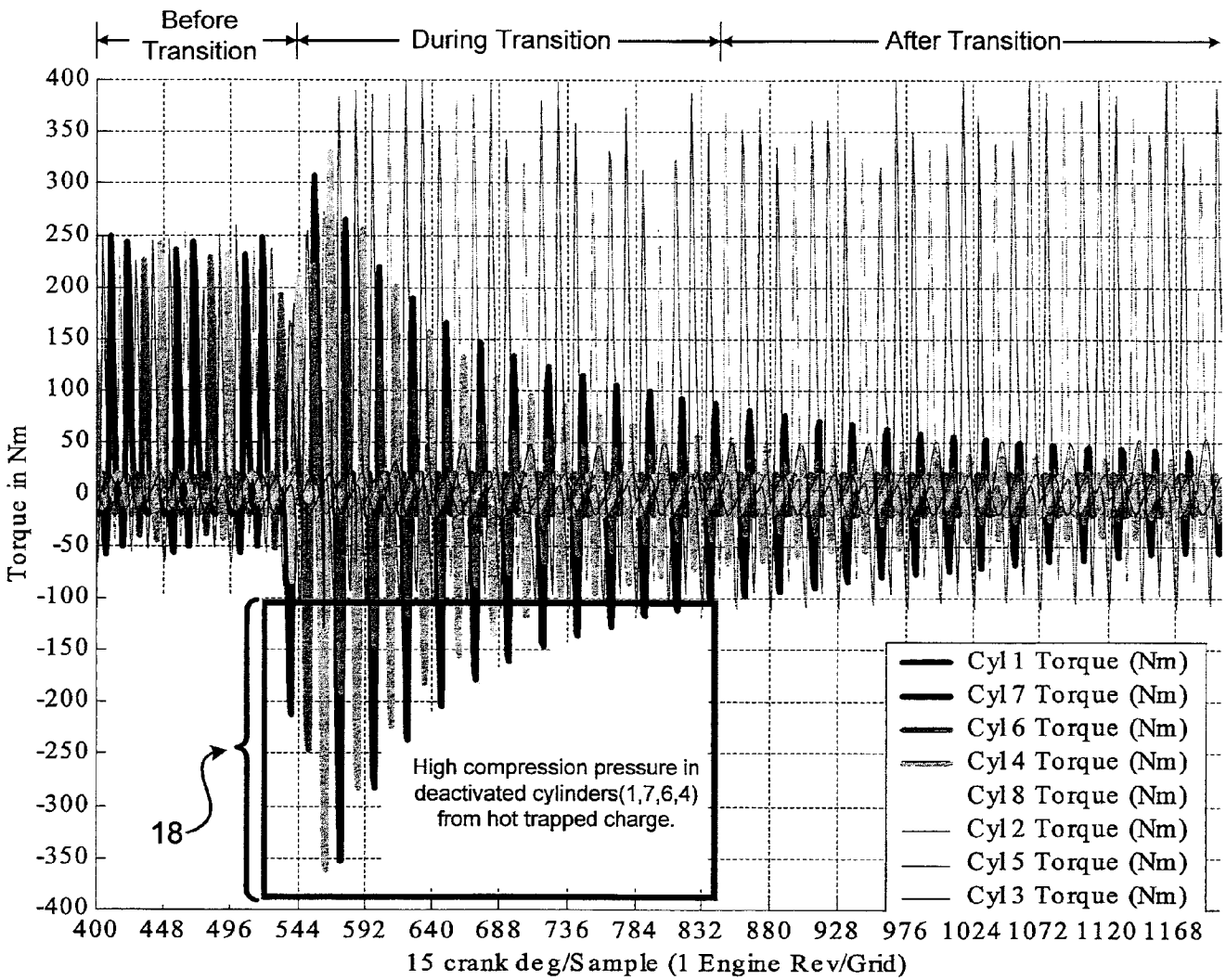
FIG. 1 is a graph of cylinder torque vs. crank angle before, during, and after a transition from an activated mode to a deactivated mode for a trapped burned charge.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Two exemplary control strategies for active fuel management (AFM) in port fuel injection engines are: 1) to trap a fresh air/fuel mixture, and 2) to trap a burned charge. Trapping a fresh air/fuel mixture may result in unpredictable combustion of the air/fuel mixture, fuel migration into the lubrication oil, and oil film degradation at the cylinder wall.

Referring to FIG. 1, a deactivated cylinder may exhibit large negative torque during a transition from an activated mode to a deactivated mode when trapping a burned exhaust charge, as indicated at 18. The large negative torque occurs because the trapped burned exhaust charge is at high pressure. When all of the selected cylinders are deactivated, expanding and compressing cylinders oppose each other and the negative torque is reduced. The high pressure eventually reduces as the cylinder cools and the exhaust gas escapes. The large torque oscillations due to the deactivated cylinders (1, 7, 6 & 4) gradually decay to a steady value after a number of engine cycles (e.g. 10 engine cycles).

A fast active fuel management (AFM) reactivation system may be used to eliminate the large negative torque resulting from the compression of hot exhaust gas. The system may involve trapping an air charge in a direct injection engine. The trapped air charge produces less negative torque than compression of hot exhaust gas. The trapped air may be mixed with fuel and ignited to quickly activate the deactivated cylinders.

Figure 2:
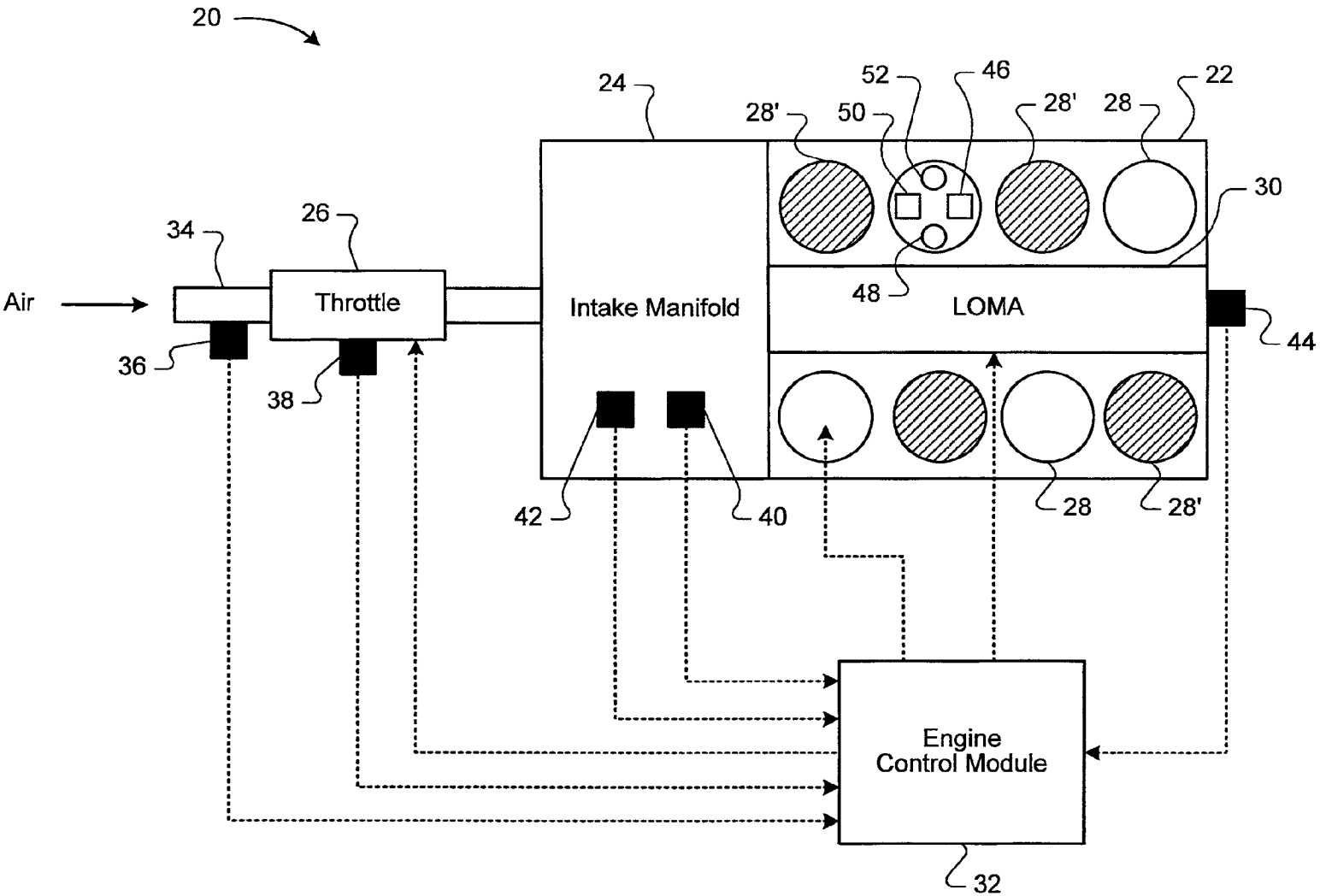
FIG. 2 is a functional block diagram that illustrates an active fuel management (AFM) engine system according to the present disclosure.

Referring now to FIG. 2, an AFM engine system 20 includes an engine 22 that combusts an air/fuel mixture to produce drive torque. Air is drawn into an intake manifold 24 through a throttle 26. The throttle 26 regulates air flow into the intake manifold 24. Air within the intake manifold 24 may be distributed into cylinders 28. One or more selected cylinders 28' may be selectively deactivated during engine operation. Although FIG. 2 depicts eight cylinders, it is appreciated that the engine 22 may include additional or fewer cylinders 28. For example, engines having 4, 5, 6, 10, 12 and 16 cylinders are contemplated.

The engine 22 includes a lifter oil manifold assembly (LOMA) 30 that deactivates the selected cylinders 28'. For example only, half of the cylinders are deactivated when the engine enters the deactivated mode, although any number of cylinders may be deactivated. Upon deactivation of the selected cylinders 28', the inlet and exhaust valves of the deactivated cylinders 28' are closed to reduce pumping losses.

The engine system 20 includes an engine control module 32 that communicates with components of the engine system 20, such as the engine 22 and associated sensors and controls as discussed herein. The engine control module 32 may implement the fast AFM reactivation system of the present disclosure.

Air is passed from an inlet 34 through a mass airflow sensor 36, such as a mass airflow meter. The sensor 36 generates a mass airflow (MAF) signal that indicates a rate of air flowing through the sensor 36. The inlet air is metered to the engine 22 via the throttle 26. For example only, the throttle 26 may be a conventional butterfly valve that rotates within the inlet air path 34. The throttle 26 is adjusted based on an operator and/or controller commanded engine operating point. The position of the throttle 26 is sensed by a throttle position sensor 38 that generates a throttle position (TPS) signal. The throttle position sensor 38 may be a rotational potentiometer.

A manifold pressure sensor 40 is positioned in the engine intake manifold 24 between the throttle 26 and the engine 22. The manifold pressure sensor 40 generates a manifold absolute air pressure (MAP) signal. A manifold air temperature sensor 42, that generates a manifold air temperature (MAT) signal based on intake air temperature, may also be located in the engine intake manifold 24.

An engine crankshaft (not shown) rotates at engine speed or a rate that is proportional to the engine speed. A crankshaft sensor 44 senses the position of the crankshaft and generates a crankshaft position (CSP) signal. The CSP signal may be related to the rotational speed of the crankshaft and cylinder events. The crankshaft sensor 44 may be a conventional variable reluctance sensor. Skilled artisans will appreciate that there are other suitable methods of sensing engine speed and cylinder events.

The engine control module 32 electronically controls a fuel injector 46 to inject fuel into one of the cylinders 28. An intake valve 48 selectively opens and closes to enable air to enter the cylinder 28. Intake valve position is regulated by a camshaft (not shown) that communicates with the LOMA 30. A piston (not shown) compresses the air/fuel mixture within the cylinder 28. The engine control module 32 controls a spark plug 50 to initiate combustion of the air/fuel mixture, driving the piston in the cylinder 28. The piston drives a crankshaft (not shown) to produce drive torque. Combustion exhaust within the cylinder 28 is forced out through an exhaust manifold (not shown) when an exhaust valve 52 is in an open position. A camshaft (not shown) regulates exhaust valve position. Although single intake and exhaust valves 48,52 are illustrated, it can be appreciated that the engine 22 may include multiple intake and exhaust valves 48,52 per cylinder 28.

Figure 3:
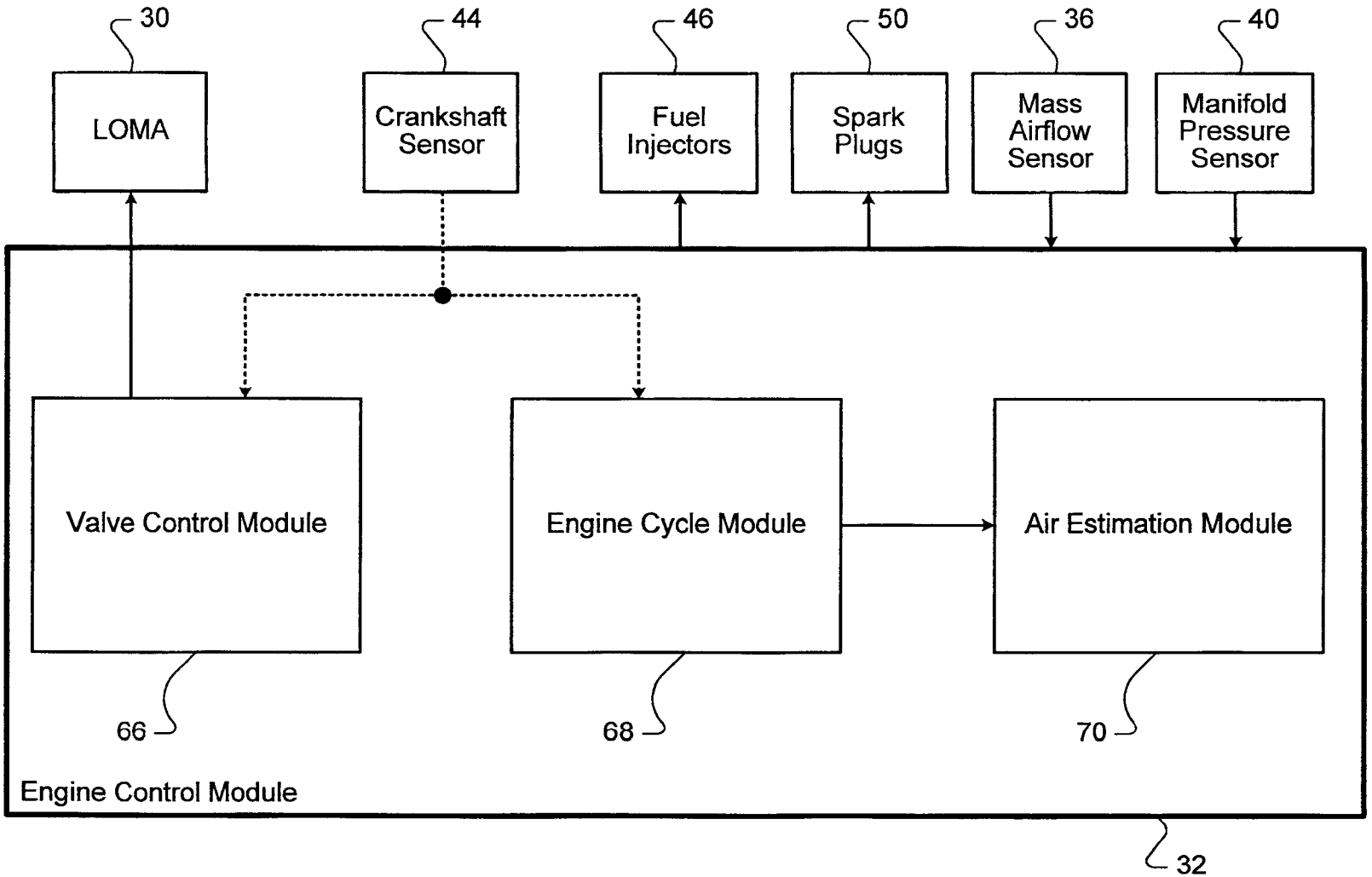
FIG. 3 is a functional block diagram of an engine control module according to the present disclosure.

Referring to FIG. 3, the engine control module 32 includes a valve control module 66, an engine cycle module 68, and an air estimation module 70. The engine control module 32 receives input signals from the engine system 20 including, but not limited to, the MAF, TPS, MAP, MAT and CSP signals (hereinafter, "engine system signals"). The engine control module 32 processes the engine system signals and generates timed engine control commands that are output to the engine system 20. For example, engine control commands may include signals that control the spark plugs 50, fuel injectors 46, throttle 26, and LOMA 30.

The engine control module 32 disables the fuel injectors 46 and spark plugs 50 to the selected inactive cylinders 28' when the engine reaches a suitable operating point for deactivation. For example only, a suitable operating point for deactivation may be during light load operating conditions (e.g. when there is sufficient reserve torque available in the deactivated mode).

The valve control module 66 uses engine system signals (e.g. a CSP signal) to determine when the selected cylinders 28' are filled with air. The valve control module 66 may determine that the selected cylinders are filled with air during an intake cycle, or upon completion of an intake cycle for the selected cylinder. The valve control module 66 disables the intake and exhaust valves 48,52 such that the selected cylinders 28' are filled with intake air. The valve control module may send engine control commands to the LOMA 30 to disable the intake and exhaust valves 48,52.

The engine control module 32 may observe inlet airflow rate characterized by MAF signals to estimate a mass of air in each of the selected cylinders 28'. The engine control module 32 may estimate the mass of air based on MAP signals and potential transient conditions as a result of cylinder deactivation. The engine control module 32 may store a plurality of estimated air mass values determined immediately after deactivation.

The engine cycle module 68 logs the number of engine cycles that pass after the selected cylinders 28' are filled with air and deactivated. Engine cycles may be determined based on engine system signals (e.g. CSP signals) and an internal counter of the engine cycle module 68. Upon reactivation, the engine cycle module 68 outputs engine cycle data to the air estimation module 70.

The air estimation module 70 uses engine cycle data to calculate the percentage of air mass remaining in the selected cylinders 28' since deactivation. The air mass percentage may be calculated based on a lookup table relating the number of engine cycles after deactivation to cylinder air mass percentage. The air estimation module 70 may store the lookup table. The air estimation module 70 may calculate the air mass percentage by using state estimators, algebraic equations, differential equations, integral equations, and/or other similar calculations.

The air estimation module 70 estimates an air mass remaining in each of the selected cylinders 28' (hereinafter, "post cycle air mass") based on the air mass percentage and the plurality of estimated air mass values. The air estimation module 70 may multiply the air mass percentage by the plurality of estimated air mass values to determine the post cycle air mass.

The engine control module 32 calculates the amount of fuel required for each deactivated cylinder 28' for efficient combustion based on the post cycle air mass estimation. The engine control module 32 enables the fuel injectors 46 and spark plugs 50 to the selected cylinders 28', along with the intake and exhaust valves 48,52. The post cycle air mass and fuel mixture are burned prior to exhaust to provide a faster torque increase and an oxygen balanced exhaust stream for a catalytic converter (not shown).

Figure 4:
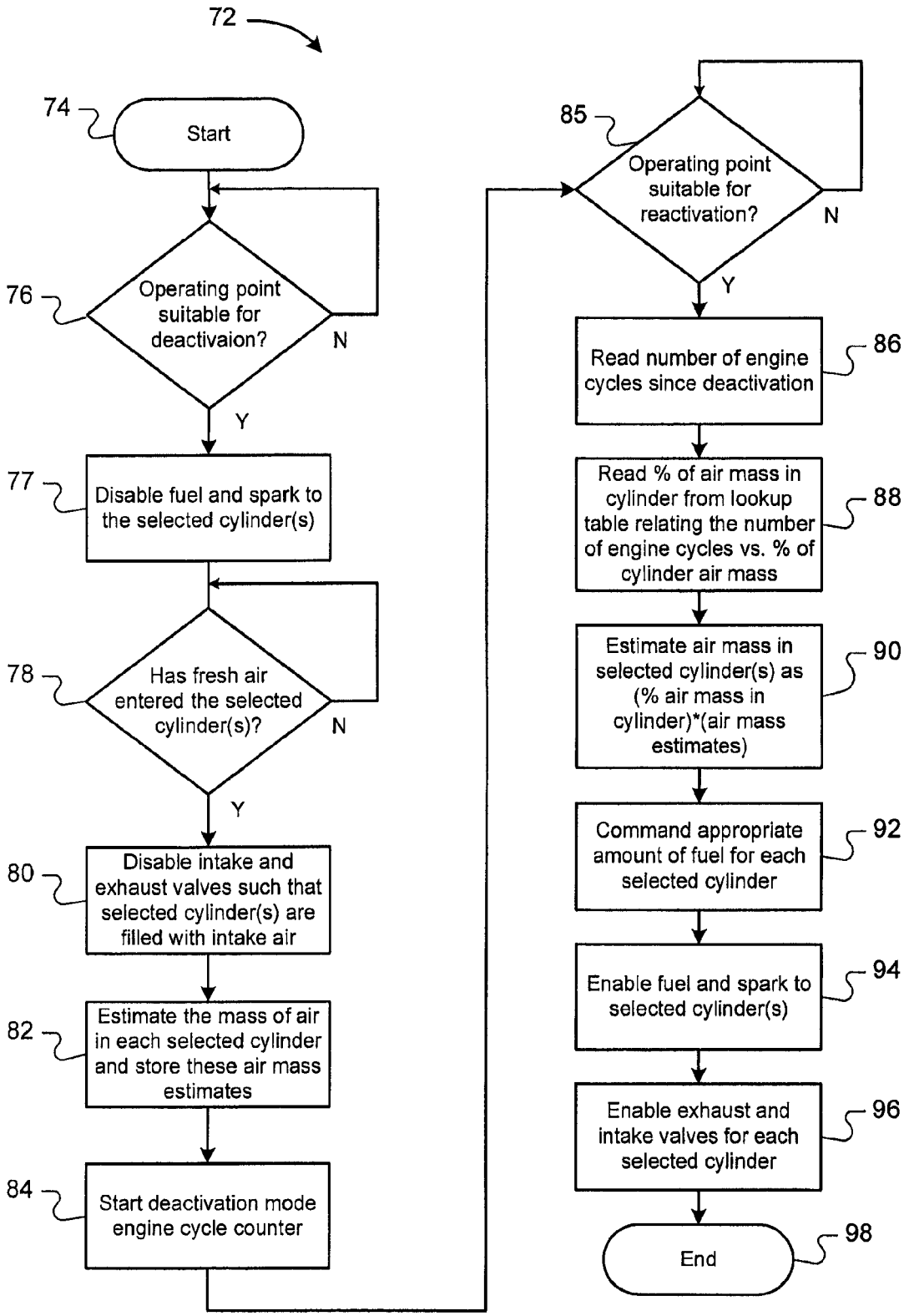
FIG. 4 is a flow diagram that illustrates the steps of a fast AFM reactivation method according to the present disclosure.

Referring to FIG. 4, a fast AFM reactivation method 72 starts in step 74. In step 76, the engine control module 32 determines whether the engine 22 has entered an operating point suitable for deactivation. If false, the method repeats step 76. If true, the method continues to step 77. In step 77, the engine control module 32 disables the fuel injectors 46 and spark plugs 50 to the selected cylinders 28'. In step 78, the valve control module 66 determines whether fresh air has entered the selected cylinders 28'. If false, the method repeats step 78. If true, the method continues to step 80. In step 80, the valve control module 66 disables intake and exhaust valves such that the selected cylinders 28' are filled with intake air. In step 82, the engine control module 32 estimates the mass of air in each selected cylinder and stores air mass estimates for the selected cylinders 28'. In step 84, the engine cycle module 68 starts a deactivation mode engine cycle counter. In step 85, the engine control module 32 determines whether the engine 22 has entered an operating point suitable for reactivation. If false, the method repeats step 85. If true, the method continues to step 86. In step 86, the engine cycle module 68 reads the number of engine cycles since deactivation. In step 88, the air estimation module 70 reads the percentage of air mass remaining in the selected cylinders 28' from a lookup table relating the number of engine cycles to the percentage of cylinder air mass. In step 90, the air estimation module 70 estimates the remaining air mass in each selected cylinder 28' by multiplying the air mass estimates by the percentage of air mass remaining in the selected cylinders 28'. In step 92, the engine control module 32 commands the appropriate amount of fuel for each selected cylinder 28' based on the remaining air mass estimation. In step 94, the engine control module 32 enables the fuel injectors 46 and spark plugs 50 to the selected cylinders 28'. In step 96, the engine control module 32 enables the intake and exhaust valves for each selected cylinder 28'. The fast AFM reactivation method 72 ends in step 98.

Figure 5:
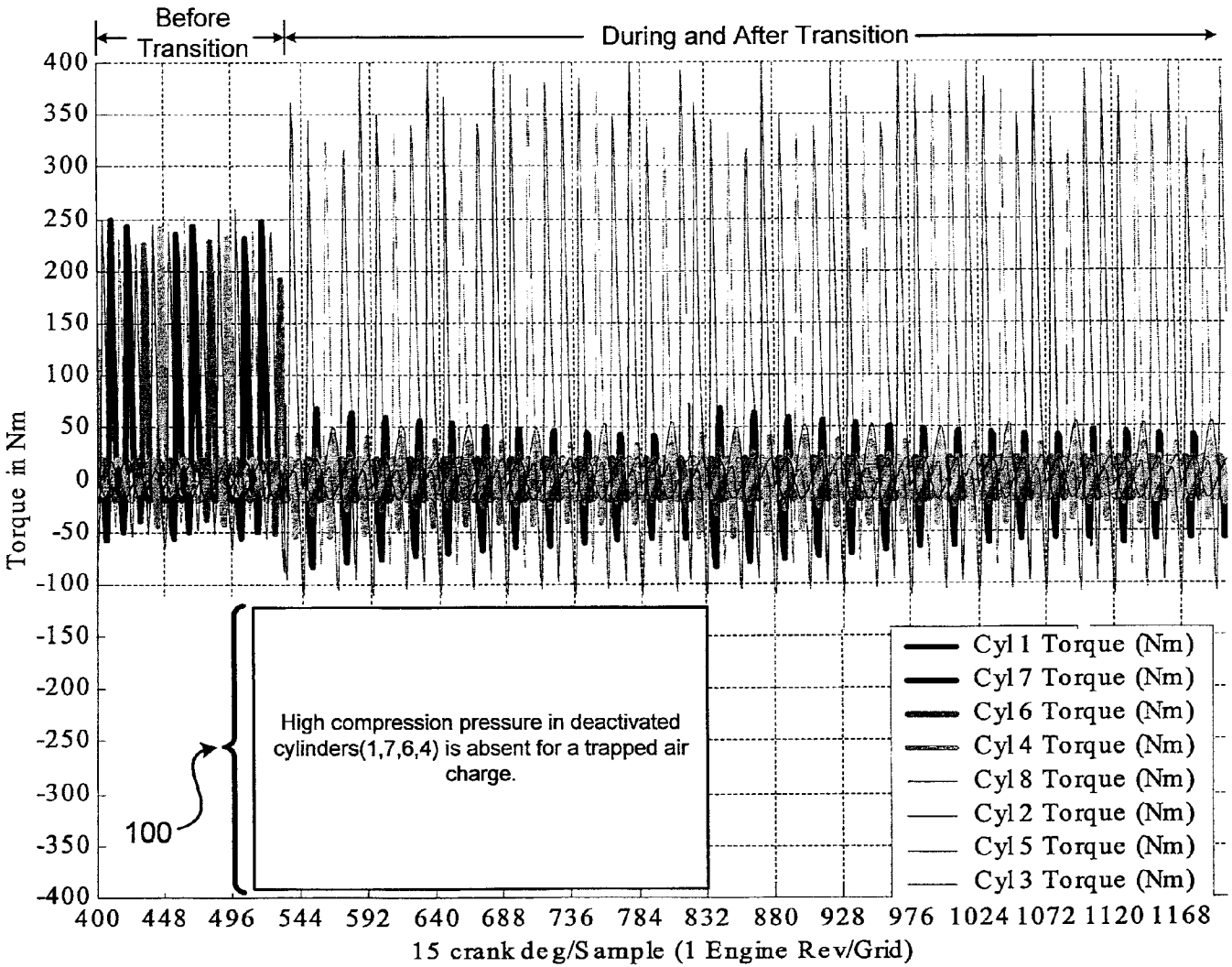
FIG. 5 is a graph of cylinder torque vs. crank angle before, during, and after a transition from an activated mode to a deactivated mode for a trapped air charge according to the present disclosure.

Referring to FIG. 5, the fast AFM reactivation system may eliminate the high negative torque excursions present in the port fuel injection control strategy, as indicated at 100. Consequently, the fast AFM system may allow for noise, vibration, and harness improvement.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An engine control module, comprising:

a valve control module that disables intake and exhaust valves corresponding to a cylinder that includes a mass of intake air;

an engine cycle module that determines a number of engine cycles that occur while said cylinder is disabled; and an air estimation module that determines a remaining mass of air in said cylinder based on said number of engine cycles.

2. The engine control module of claim 1 wherein said valve control module communicates with a lifter oil manifold assembly (LOMA) to disable said intake and exhaust valves.

3. The engine control module of claim 1 wherein said engine cycle module determines said number of engine cycles based on a crankshaft position signal.

4. The engine control module of claim 1 wherein said air estimation module determines said remaining mass of air in said cylinder based on at least one of a state estimate, an algebraic equation, a differential equation, and an integral equation.

5. The engine control module of claim 1 further comprising a lookup table, wherein said air estimation module determines said remaining mass of air in said cylinder based on said lookup table.

6. The engine control module of claim 5 wherein said lookup table includes a plurality of engine cycle values and a corresponding plurality of air mass percentage values.

7. The engine control module of claim 6 wherein said air estimation module determines said remaining mass of air by multiplying one of said plurality of air mass percentage values by said mass of intake air.

8. A method for controlling an engine, comprising:

disabling intake and exhaust valves corresponding to a cylinder that includes a mass of intake air;

determining a number of engine cycles that occur while said cylinder is disabled; and determining a remaining mass of air in said cylinder based on said number of engine cycles.

9. The method of claim 8 further comprising communicating with a lifter oil manifold assembly (LOMA) to disable said intake and exhaust valves.

10. The method of claim 8 further comprising determining said number of engine cycles based on a crankshaft position signal.

11. The method of claim 8 further comprising determining said remaining mass of air in said cylinder based on at least one of a state estimate, an algebraic equation, a differential equation, and an integral equation.

12. The method of claim 8 further comprising determining said remaining mass of air in said cylinder based on a lookup table.

13. The method of claim 12 wherein said lookup table includes a plurality of engine cycle values and a corresponding plurality of air mass percentage values.

14. The method of claim 13 further comprising determining said remaining mass of air by multiplying one of said plurality of air mass percentage values by said mass of intake air.

* * * * *